US007502574B2

(12) United States Patent
Suzuki et al.

(10) Patent No.: US 7,502,574 B2
(45) Date of Patent: Mar. 10, 2009

(54) IMAGE FORMING APPARATUS INCLUDING A SEAL MEMBER IN CONTACT WITH AN IMAGE BEARING MEMBER AND A FLANGE PROVIDED AT AN END OF THE IMAGE BEARING MEMBER

(75) Inventors: Kenji Suzuki, Abiko (JP); Takuya Terae, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 73 days.

(21) Appl. No.: 11/470,122

(22) Filed: Sep. 5, 2006

(65) Prior Publication Data

US 2007/0059030 A1 Mar. 15, 2007

(30) Foreign Application Priority Data

Sep. 13, 2005 (JP) ..... 2005-266115

(51) Int. Cl.
*G03G 21/00* (2006.01)

(52) U.S. Cl. ..... 399/102

(58) Field of Classification Search ..... 399/102, 399/159, 350

See application file for complete search history.

(56) References Cited

U.S. PATENT DOCUMENTS 5,362,588 A * 11/1994 Yoshihara et al. ..... 399/159

FOREIGN PATENT DOCUMENTS

JP 07334056 A * 12/1995
JP 2000-132027 5/2000

* cited by examiner

*Primary Examiner*—David M Gray
*Assistant Examiner*—Erika Villaluna
(74) *Attorney, Agent, or Firm*—Fitzpatrick, Cella, Harper & Scinto

(57) ABSTRACT

Toner remaining on a photosensitive drum may be prevented from being given out after a toner image is transferred, by causing a seal member to abut on both a photosensitive portion of the photosensitive drum and a flange disposed on each of ends of the photosensitive portion and having less hardness than the photosensitive portion, further a flange being configured to be smaller in outer diameter than the photosensitive portion so that a contact pressure of the seal member on the flange may be reduced, and accordingly, in an image formation apparatus, this may allow flange galling to reduce without seal characteristic degradation.

3 Claims, 9 Drawing Sheets

PRIOR ART

PRIOR ART

PRIOR ART

IMAGE FORMING APPARATUS INCLUDING A SEAL MEMBER IN CONTACT WITH AN IMAGE BEARING MEMBER AND A FLANGE PROVIDED AT AN END OF THE IMAGE BEARING MEMBER

BACKGROUND OF THE INVENTION

1. Field of the Invention

The present invention relates to an image formation apparatus, and in particular to a configuration for preventing toner remaining on a photosensitive drum from being given out after a toner image is transferred.

2. Description of the Related Art

Conventionally, in an image formation apparatus such as a copy machine, printer and facsimile which provide image formation by using electrophotographic technology, and after a toner image is formed on a photosensitive drum, i.e. an image bearing member, this toner image is transferred onto a sheet or intermediate transfer belt at a transfer portion. Moreover, when the toner image on the photosensitive drum is transferred at the transfer portion in such a manner, toner may remain on the photosensitive drum, and in such a case, the residual toner may be reclaimed by a cleaning device.

The residual toner may be corrected, for example by bringing a cleaning blade into abutment on the photosensitive drum. However, in the case of using this cleaning blade, because the residual toner may run away transversely on the cleaning blade, a seal 71 is provided on each of ends of a cleaning blade 28 in order to block the toner, as shown in FIG. 6.

Further, on the outside of the seal 71 is disposed a seal 74 for sealing an aperture of a cleaning container, and these two seals 71 and 74, both are arranged to contact with the surface of the photosensitive drum in the entireties of their longitudinal portions.

Moreover, this seal 74 is disposed to always contact with a circumferential abutting surface 82 shown by a shaded area where a spacing member 81 abuts on a photosensitive drum 1, as shown in FIG. 7. Further, this spacing member 81 spaces apart a developing sleeve 4*b* for supplying toner to the photosensitive drum 1 and the photosensitive drum 1.

Further, this seal 74 is, as disclosed in Japanese Patent Application Laid-Open No. 2000-132027 (see FIG. 8), a two-layer structure composed of a raising member 74*a* abutting on the photosensitive drum 1 and an elastic member 74*b* such as a sponge, and the elastic member 74*b* is attached to a cleaning container 91 by using double-faced adhesive tape.

Then, by providing such a seal 74, even if toner adheres to the spacing member 81 and subsequently to the circumferential abutting surface 82 of the photosensitive drum 1, the residual toner may be wiped off by the seal 74 when the photosensitive drum 1 rotates.

In such a conventional image formation apparatus, an image region has extended more in the direction perpendicular to the sheet feed direction because of demands for paper extension, a frameless image and the like, and therefore, a photosensitive drum tends to extend in width direction.

However, if a photosensitive drum changes in length as such, a conventional drum manufacturing facility becomes unusable so that a new facility is to be necessary, and accordingly, the drum will be expensive. As a result, the entire product cost of an image formation apparatus and service parts costs of a process cartridge and the like will be raised.

Then, to use a photosensitive drum having a conventional length, for example, a cylinder 1*a* of a photosensitive drum 1 shown in FIG. 9A remains the same, while a flange 1*b* made of resin may be configured to be wider to provide a longer virtual drum length, as shown in FIG. 9B.

Here, when the drum length is virtually elongated in such a manner, positions of seals 74 shown in FIG. 9A are required to be displaced to positions shown in FIG. 9B. Then, when the seals 74 are moved to the positions shown in FIG. 9B, the seals 74 may be arranged to overlie both the cylinder 1*a* and the flange 1*b*.

However, if the seals 74 are arranged in such configuration, the flanges 1*b* made of resin may be ground to wear away due to difference between materials of the cylinder 1*a* and the flanges 1*b* and difference in surface characteristics. Moreover, if a contact pressure of the seals 74 is configured to be lower so that the flanges 1*b* may not be ground, seal characteristic cannot be satisfied. That is, if the seals 74 are arranged to overlie both the cylinder 1*a* and the flanges 1*b*, it may be difficult to satisfy both endurance and seal characteristic.

SUMMARY OF THE INVENTION

An object of the present invention, addressing such actual situations, is to provide an image formation apparatus in which damage from flange galling can be reduced without seal characteristic degradation.

Anther object of the present invention is to provide an image formation apparatus, comprising: a photosensitive drum including a drum portion on which a toner image is formed, the drum portion having a photosensitive portion, and a resin substrate which is provided on ends of the drum portion, an outer diameter of the resin substrate being smaller than those of the photosensitive portion, transfer means which transfers an toner image on said photosensitive drum onto a transfer member, cleaning means for cleaning up residual toner after transfer, and a seal member which preventing toner from being given out from ends of said cleaning means, wherein said seal member is in contact with both one of the ends of said photosensitive portion and said resin substrate so as to reduce a contact pressure of said seal member against said resin substrate.

Anther object of the present invention is to provide an image formation apparatus including a photosensitive drum including a drum portion on which a toner image is formed, the drum portion having a photosensitive portion, and a resin substrate which is provided on ends of the drum portion, an outer diameter of the resin substrate being smaller than those of the photosensitive portion, exposure means which forms a latent image on said photosensitive drum, developing means which develops the latent image using toner, and a seal member for preventing toner from being given out from ends of said developing means, wherein said seal member is in contact with both one of the ends of said photosensitive portion and said resin substrate so as to reduce a contact pressure of said seal member on said resin substrate.

A still further object of the present invention will be apparent from reference to the following description and the accompanying drawings.

SUMMARY OF THE INVENTION

DESCRIPTION OF THE EMBODIMENTS

The embodiments for carrying out the present invention will be described hereinafter with reference to the drawings.

Figure 1:
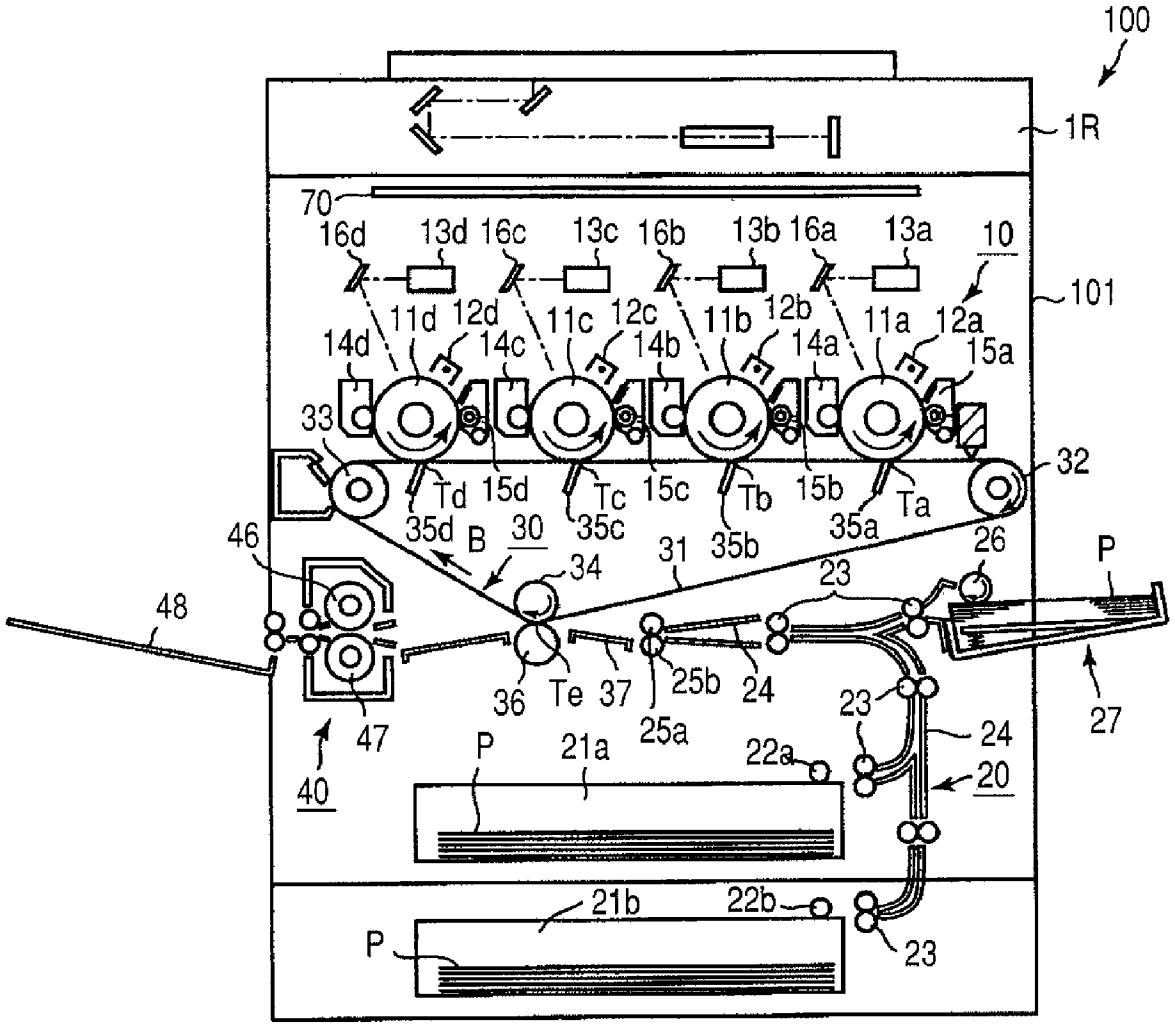
FIG. 1 shows a configuration of a color printer as an example of an image formation apparatus according to an embodiment of the present invention.

FIG. 1 shows a configuration of a color printer as an example of an image formation apparatus according to an embodiment of the present invention. Further, this color printer prints a copy image by using a toner image in four colors, i.e. magenta, cyan, yellow and black.

In FIG. 1, a color printer 100 as an image formation apparatus includes a color printer main body 101 (hereinafter referred to as "printer main body"). This printer main body 101 is provided with an image formation portion 10 and an intermediate transfer portion 30.

Also, a cassette paper feed portion 20 including cassettes 21 (21*a*, 21*b*) is provided under the printer main body 101, and a manual paper feed portion 27 is provided on one side of the printer main body 101. Sheets P contained in each of the paper feed portions 20, 27 are selectively fed out in turn from the top sheet by pick-up rollers 22*a*, 22*b* and 26.

Subsequently, the sheets P are delivered to a pair of registration rollers 25 (25*a*, 26*b*) of which rotation is suspended. The skew feeding of the sheets are corrected by this pair of the registration rollers 25. Further, the sheets P fed from the cassette 21 traveling a long distance to the pair of the registration rollers 25 are delivered through a sheet delivery path 24 to the pair of the registration rollers 25 by a plurality of a pair of delivery rollers 23.

Also, a long intermediate transfer belt 31 (an endless belt) as a secondary transfer member provided in the intermediate transfer portion 30 has its tension established and also is rotated clockwise shown by an arrow B by a driving roller 32, a driven roller 33 and a tension roller 34.

Further, rotatable photosensitive drums 11 (11*a* to 11*d*) are a plurality of image bearing members which constitute the image formation portion 10 and which form and bear a color toner image in different colors, and they are disposed in series on the upper horizontal plane of this intermediate transfer belt 31 in a rotation direction of the intermediate transfer belt 31. Moreover, in this embodiment, the photosensitive drum 11*d* in the uppermost stream in rotation direction of the intermediate transfer belt bears the magenta toner image. Also, next photosensitive drum 11*c* bears the cyan toner image, next, the photosensitive drum 11*b* bears the yellow toner image, and finally, photosensitive drum 11*a* bears the black toner image, respectively. Further, this intermediate transfer belt 31 is abutted on by a pair of secondary transfer rollers 36 which constitute a secondary transfer portion Te along with the intermediate transfer belt 31.

Further, primary charging devices 12 (12*a* to 12*d*) for charging uniformly each of the photosensitive drums 11 and developing devices 14 (14*a* to 14*d*) i.e. developing means for developing an electrostatic latent image formed on the photosensitive drums 11 as will be described below are provided around the photosensitive drums 11. Moreover, laser exposure optical systems 13 (13*a* to 13*d*), i.e. exposure means which project a laser beam to the photosensitive drum 11 to form the electrostatic latent image on the photosensitive drum 11 and photosensitive member cleaners 15 (15*a* to 15*d*) as described below are provided.

Further, in FIG. 1, a scanner 1R reads an original document placed on a copy board (a platen glass) not shown in FIG. 1.

Next, image formation operation by the color printer 100 in this configuration will be described.

First, an image (here, a color image) of an original document placed on the document glass (not shown) is read by the scanner 1R, and subsequently, the color image read is resolved into four color components of magenta, cyan, yellow and black, which are temporarily stored in image memories not shown in figures.

Next, the photosensitive drum 11 is rotated counterclockwise to be neutralized by a preceding exposure lamp not shown in figures, and subsequently, the surface of the photosensitive drum 11 is uniformly charged by the primary charging device 12. Then, a laser beam is created by the laser exposure optical system 13 based on the image information stored in the image memories and subsequently the laser beam for each of color components is projected in turn through its own reflecting mirror 16 (16*a* to 16*d*) onto the surface of its respective photosensitive drum 11 which rotates.

In other words, first, the laser beam based on the magenta component of the image is projected onto the photosensitive drum 11*d* in the uppermost stream to form an electrostatic latent image of the magenta component on the photosensitive drum 11*d*. Then, the electrostatic latent image is visualized by using magenta toner which is made of resin and pigment as a base substance and supplied from the developing device 14*d*. Further, the toner in the developing device is appropriately re-supplied from a toner storage portion in desired timing so that a toner ratio (or an amount of the toner) in the developing device is kept to be constant.

Next, the laser beam based on the cyan component of the image is projected onto the photosensitive drum 11*c* to form an electrostatic latent image of the cyan component on the photosensitive drum 11*c*. Then, the electrostatic latent image is visualized by using cyan toner supplied from the developing device 14*c*. Next, the laser beam based on the yellow component of the image is projected onto the photosensitive drum 11*b* to form an electrostatic latent image of the yellow component on the photosensitive drum 11*b*. Then, the electrostatic latent image is visualized by using yellow toner supplied from the developing device 14*b*.

Next, the laser beam based on the black component of the image is projected onto the photosensitive drum 11*a* to form an electrostatic latent image of the black component on the photosensitive drum 11*a*. Then, the electrostatic latent image is visualized by using black toner supplied from the developing device 14*a*.

Next, the intermediate transfer belt 31 is passed through in series a transfer portion Ta (Ta to Td) composed of the photosensitive drums 11 and primary transfer blades 35 (35*a* to 35*d*) so that the toner images of magenta, cyan, yellow and black components overlap on the intermediate transfer belt 31.

While, the pair of registration rollers 25 is activated right on cue to align a front edge location of the sheet with the toner image overlapped on the intermediate transfer belt 31, thereby delivering the sheet P rearranged for displacement correction to the secondary transfer portion Te. The toner images of magenta, cyan, yellow and black components overlapped on the intermediate transfer belt 30 are transferred at once onto the sheet P delivered to the secondary transfer portion Te in this way at the secondary transfer portion Te.

Next, the sheet P which passed through the secondary transfer portion Te is delivered to a fixing device 40 by the intermediate transfer belt 30, and subsequently the sheet P is heated by a fixing roller 46 in the fixing device 40 and pressurized by a pressure roller 47 to fix the transferred toner image on the surface of the sheet. Then, subsequently the sheet P which passed through the fixing device 40 and was processed in fixing is discharged onto a discharge tray 48 outside the printer main body.

Now, a configuration of a photosensitive member cleaner 15 according to an embodiment of the present invention will be described.

Figure 2:
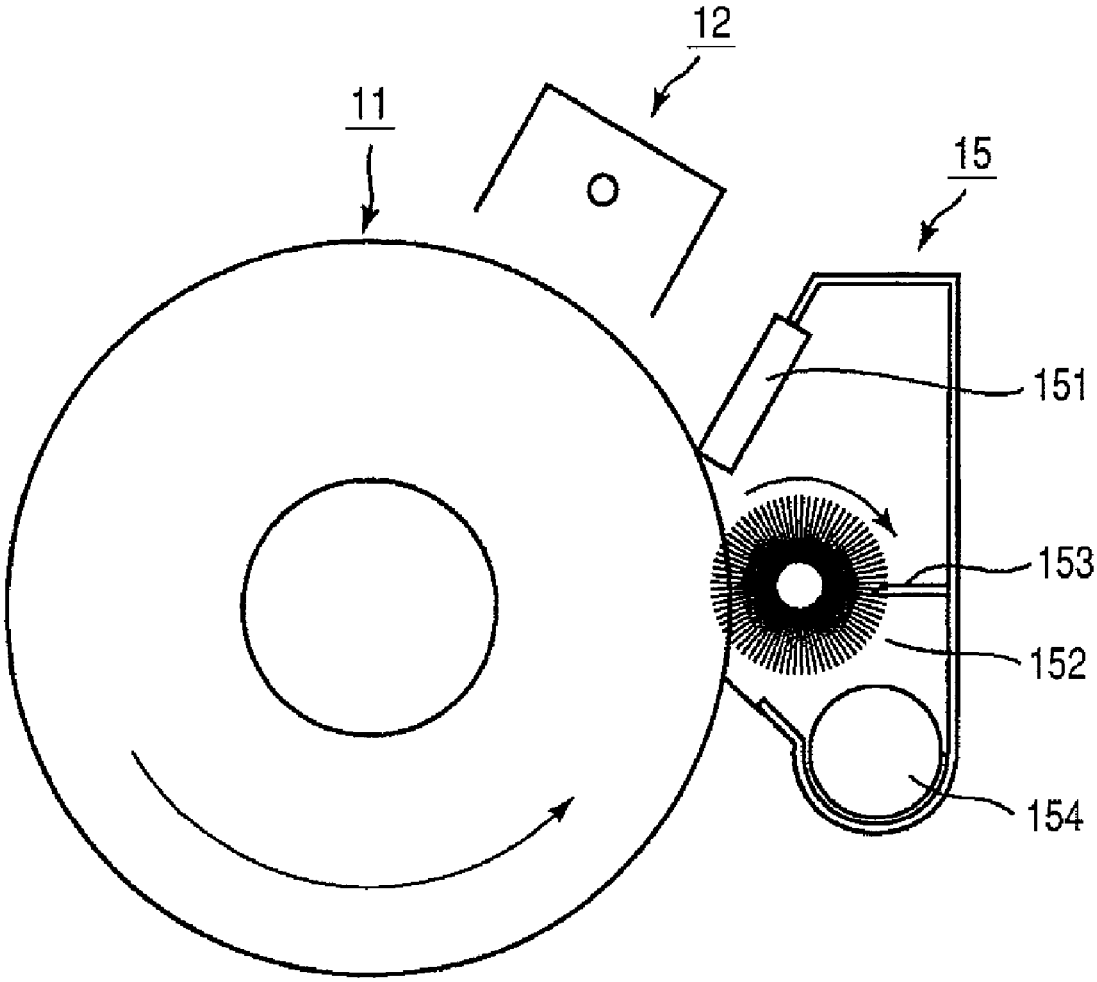
FIG. 2 is a detailed cross sectional view of a cleaner portion of a photosensitive body disposed in the color printer above.

FIG. 2 is a detailed cross sectional view of the photosensitive member cleaner portion 15 which is a toner collection portion for collecting residual toner on a photosensitive drum. Moreover, since the present color printer 100 is an image formation apparatus of a quadruple tandem system which includes four identical drum units, one unit will be described.

The photosensitive member cleaner portion 15 is provided with a cleaning blade 151 and a fur brush 152 as cleaning means abutting on a photosensitive drum 11, as shown in FIG. 2, and the residual toner not transferred to be left behind at the primary transfer portion 35 is collected by the fur brush 152 and the cleaning blade 151. Further, in FIG. 2, a scraper 153 removes the residual toner adhered to the fur brush 152, and a delivery screw 154 delivers the residual toner collected by the fur brush 152 and the cleaning blade 151 to a toner storage portion.

Figure 3:
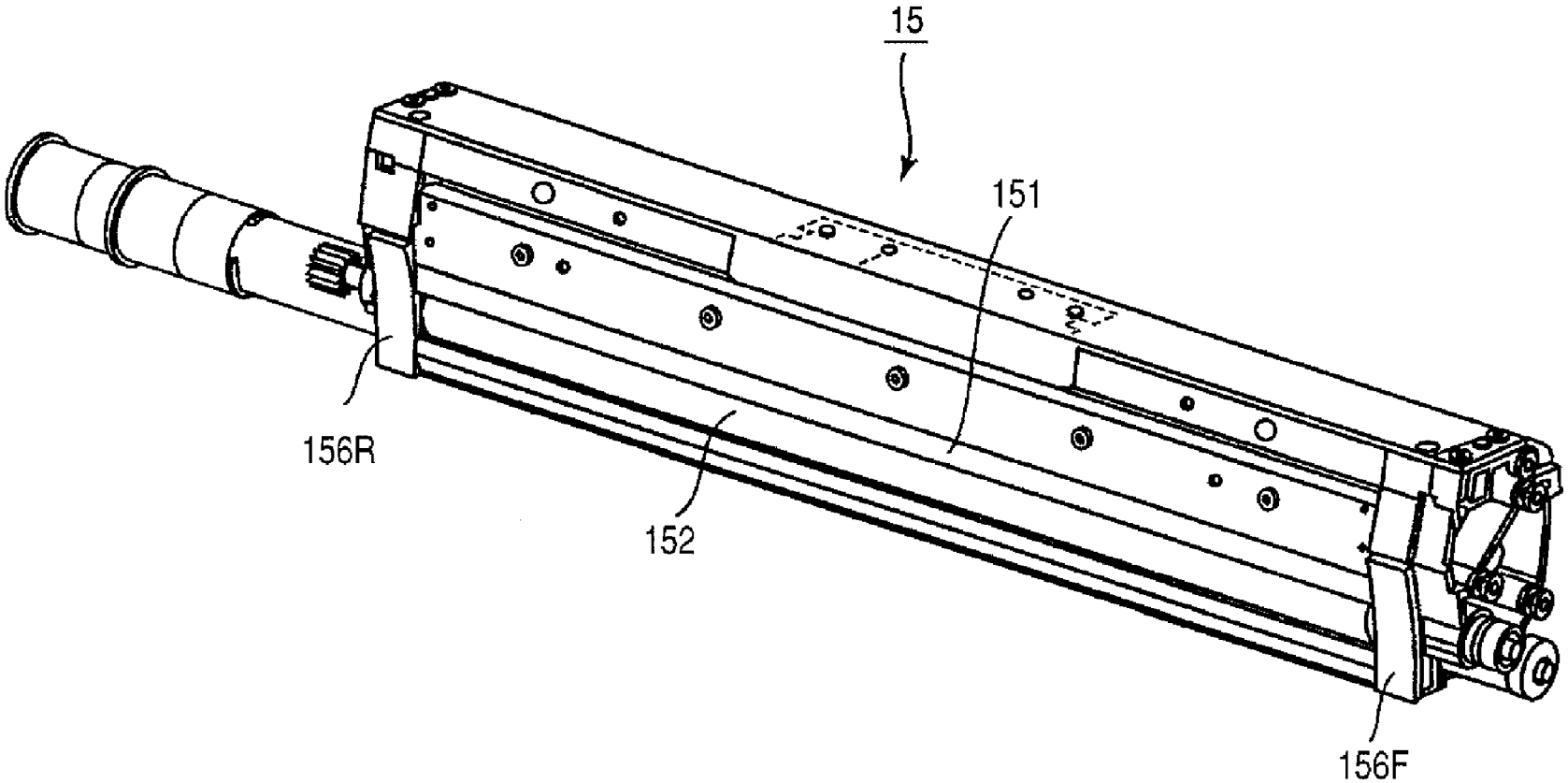
FIG. 3 is a perspective view of the cleaner portion of the photosensitive body above.

However, as described above, a part of the residual toner collected may run transversely away backward and forward on a nip portion between the fur brush 152, the cleaning blade 151 and the photosensitive drum 11 due to rotation of the photosensitive drum 11. Therefore, to block this toner, as shown in FIG. 3, the photosensitive member cleaner 15 is provided with a fore side seal 156F and a rear side seal 156R as sealing members.

The photosensitive drum 11, here, includes a drum cylinder 111 (a drum portion) which is a photosensitive portion having a photosensitive layer and drum flanges 112

Figure 4:
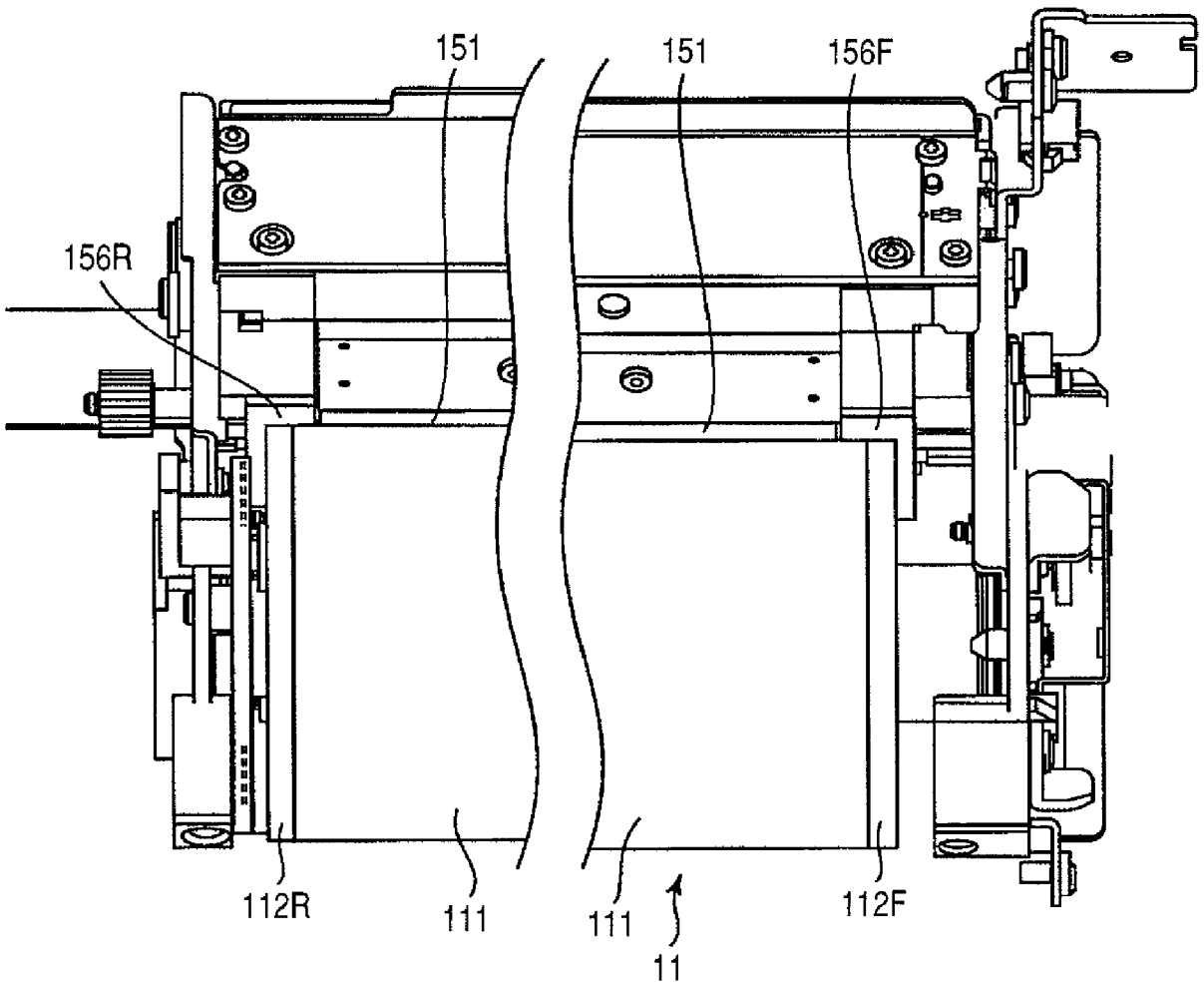
FIG. 4 is a top view of essential portions of both ends of the cleaner portion of the photosensitive body above.

F, 112R) disposed on both ends of the drum cylinder 111, as shown in FIG. 4. The drum flanges 112 (112F, 112R) are a resin substrate which conveys power to the photosensitive drum 11 to rotate and pivotally supports both ends of this photosensitive drum.

Then, the photosensitive drum 11 is arranged so that the width of the drum flange 112 may be increased for virtual extension of a drum length and that each of the side seals 156 (156F, 156R) may abut on the drum flange 112 and the end of the drum cylinder 111.

Further, a base material of the drum cylinder 111 is coated with aluminum and the surface thereof is coated with a photosensitive layer. Moreover, resin such as polycarbonate and the like is used for the drum flange 112, which may make the drum flange 112 less hard than the drum cylinder 111. Here, this means that the drum flange 112 has worse surface characteristic (a coefficient of friction) although the drum cylinder 111 has good surface characteristic, and also has smaller hardness. Accordingly, if the drum flange 112 is configured to have the same outer diameter as the drum cylinder 111 and the side seal 156 applies a contact pressure to the drum flange 112, the outer surface of the drum flange 111 may gall off at the outer surface.

Figure 5:
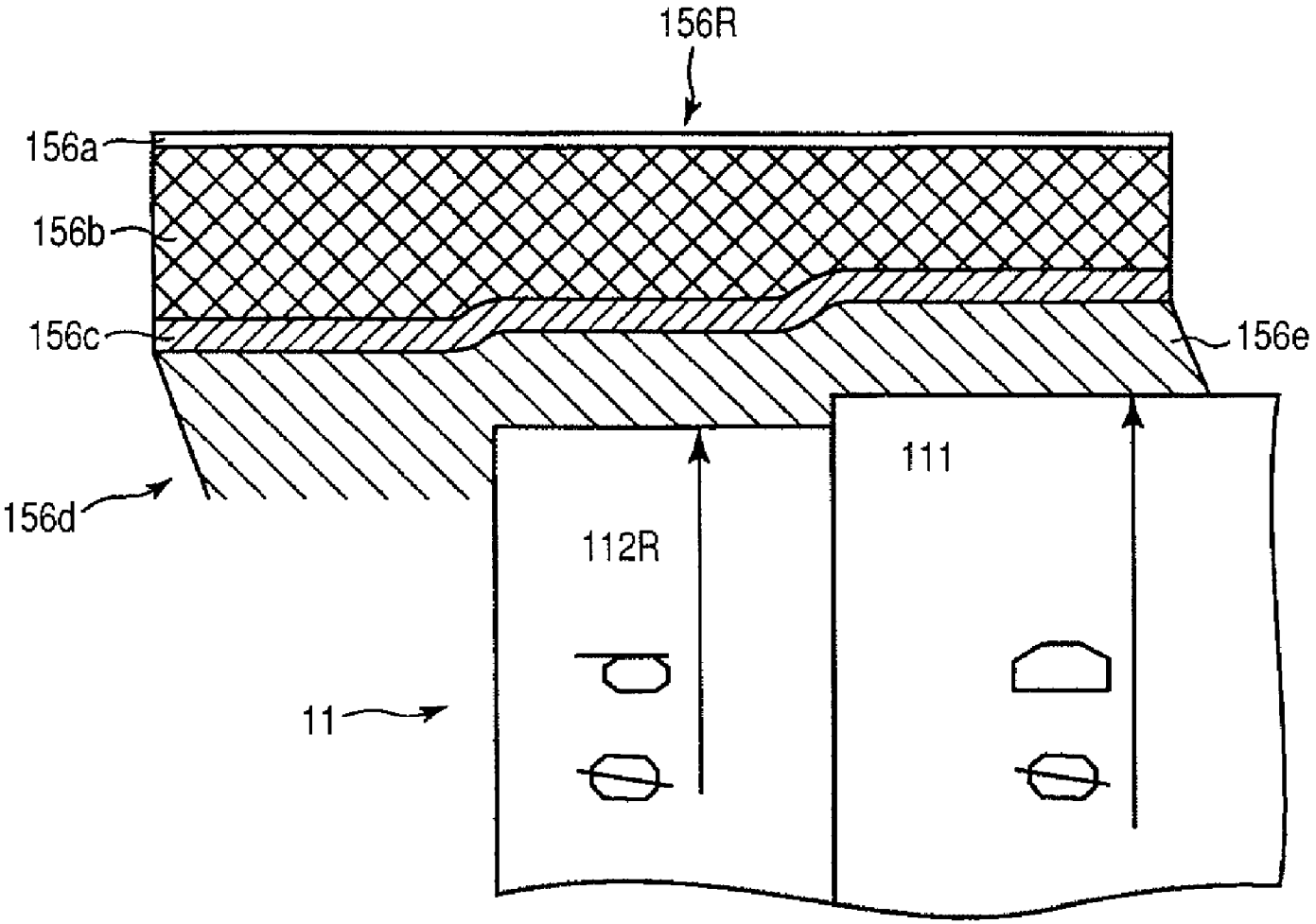
FIG. 5 illustrates situations in which a side seal disposed in the cleaner portion of the photosensitive body above abuts on a photosensitive drum.
Figure 6:
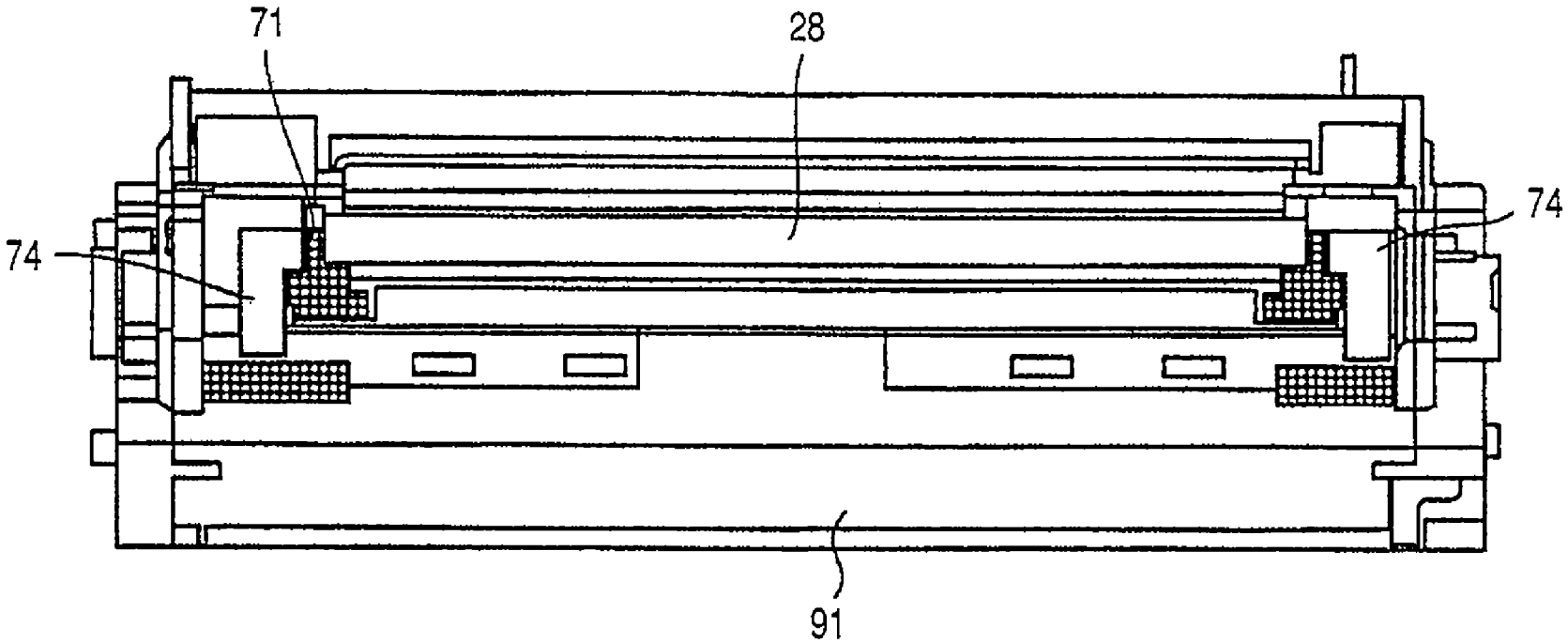
FIG. 6 illustrates a configuration of a conventional cleaning device.
Figure 7:
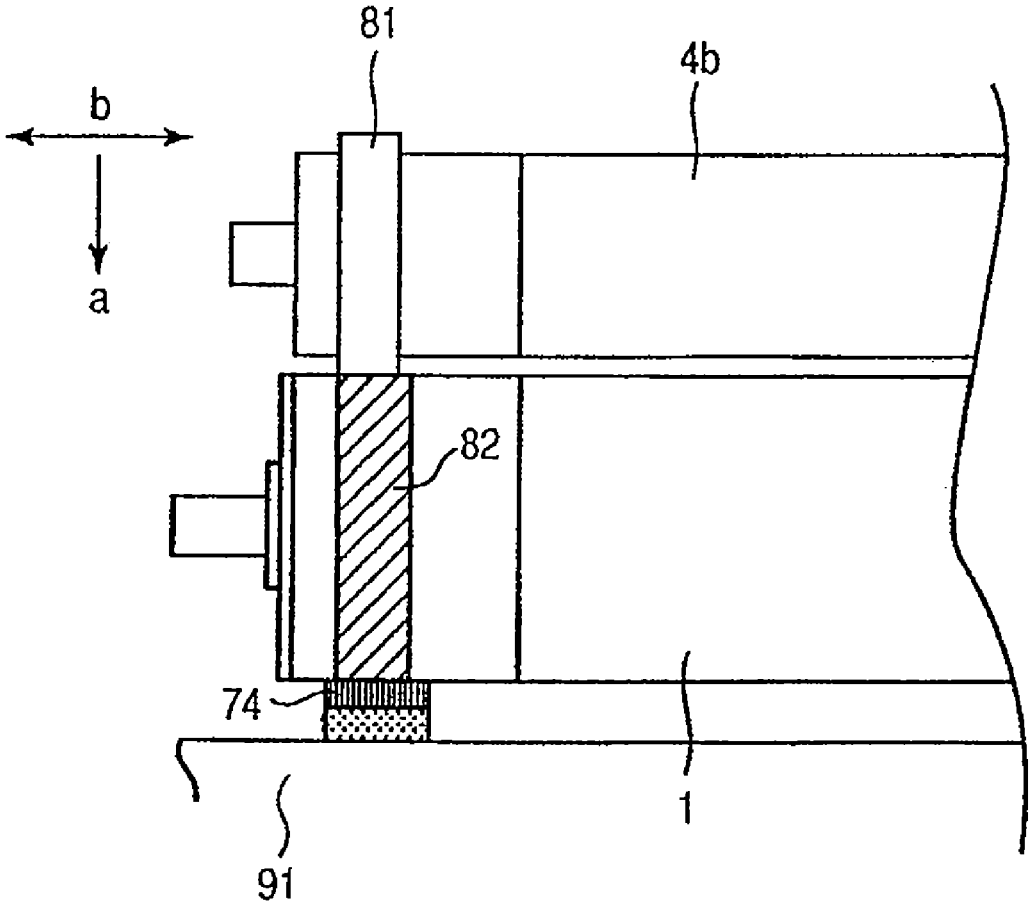
FIG. 7 illustrates arrangement of a seal disposed in the conventional cleaning device above.
Figure 8:
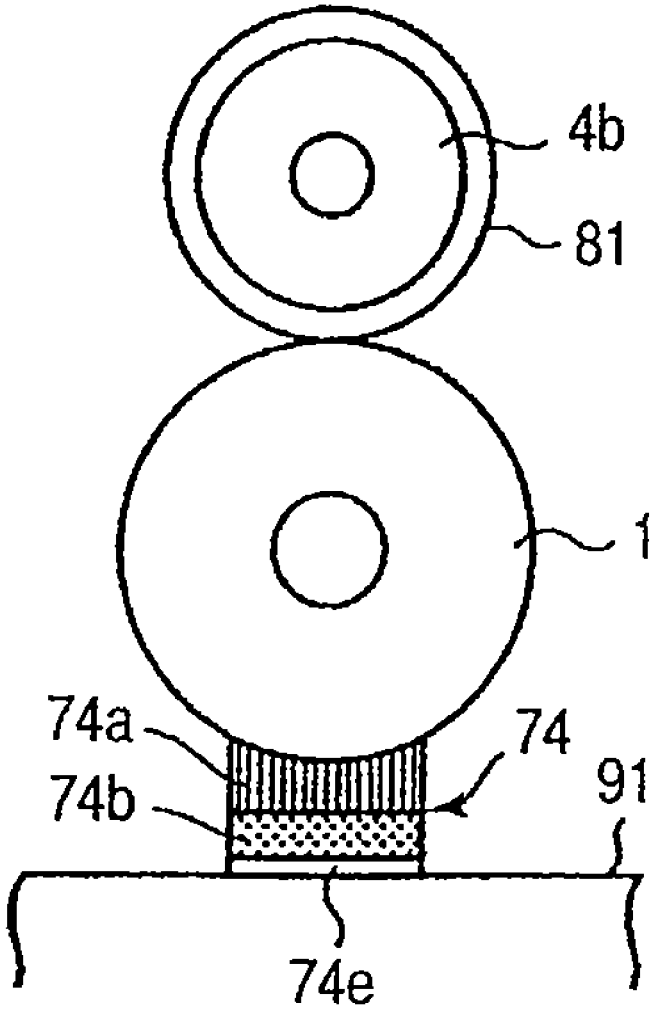
FIG. 8 illustrates a configuration of the seal disposed in the conventional cleaning device above.
Figures 9A, 9B:
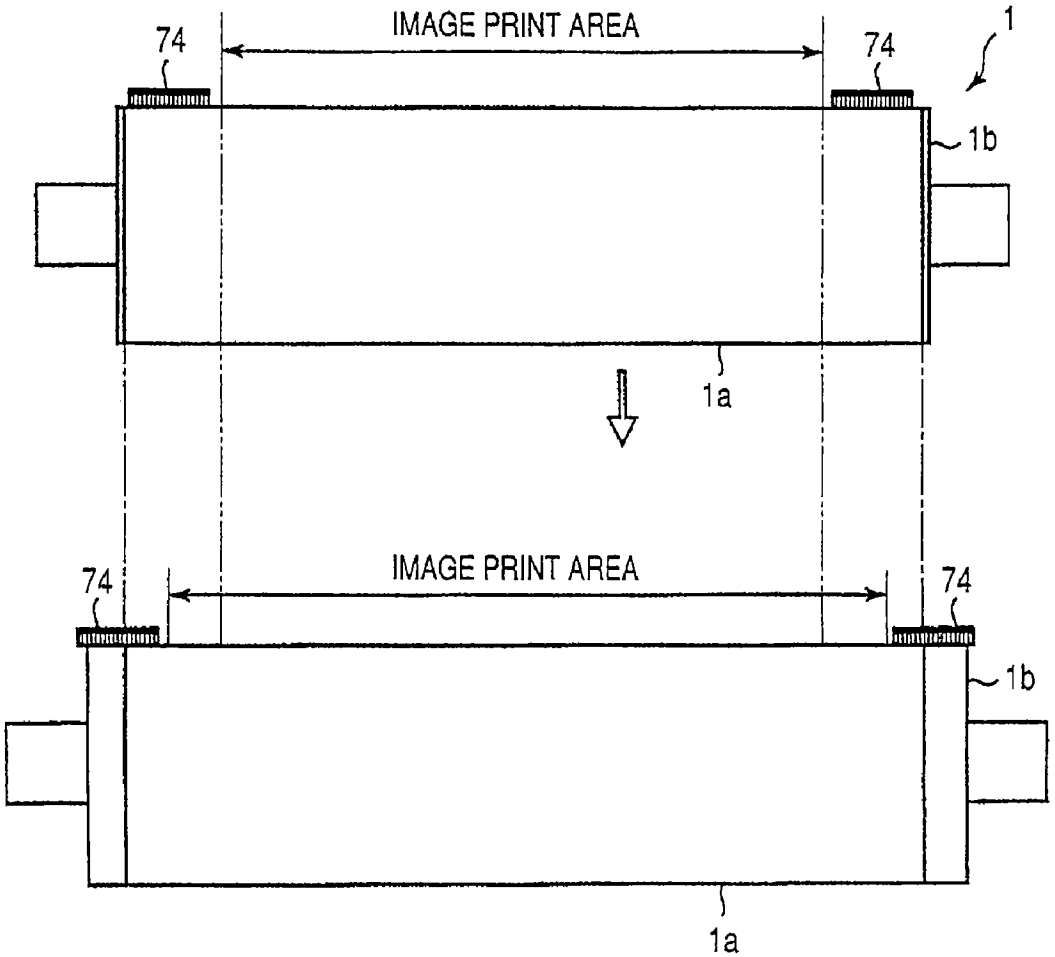
FIG. 9B PRIOR ART
FIGS. 9A and 9B show a configuration of a conventional photosensitive drum.

Therefore, in this embodiment, the drum flange 112R is configured to be slightly smaller in outer diameter than the drum cylinder 111, as shown in FIG. 5. Accordingly, the abutting pressure applied to the drum flange 112R by the rear side seal 156R may be reduced, which can prevent the drum flange 112R from galling off.

Further, in FIG. 5, a configuration of the side of one end portion of the drum cylinder 111 is shown, while the side of the other end portion of the drum cylinder 111 is also configured similarly, that is, the drum flange 112F is slightly smaller in outer diameter than the drum cylinder 111.

However, when the rear side seal 156R is configured to abut on the drum flange 112R and the side of the end portion of the drum cylinder 111 in such a manner, the rear side seal 156R abuts in narrower width on the side of the end portion of the drum cylinder 111.

Therefore, an increase in height of a step between the drum flange 112R and the drum cylinder 111 due to the difference in outer diameter between the drum flange 112R and the drum cylinder 111 may cause seal characteristic to be degraded. In other words, the smaller in outer diameter than the drum cylinder 111 the drum flange 112R is, the more the flange galling may be prevented, while too much decrease in the outer diameter of the drum flange 112R may cause the seal characteristic to be degraded.

Then, it is necessary to find out optimal values of the outer diameter ϕD of the drum cylinder 111 and the outer diameter ϕd of the drum flange 112R which may not degrade the seal characteristic and cause the flange galling.

The following table 1 shows correlation among the difference between the cylinder/flange outer diameters, the seal characteristic and the flange galling.

TABLE 1

| | D − d (mm) | | | | | | |
|---|---|---|---|---|---|---|---|
| | 0.00 | 0.05 | 0.10 | 0.30 | 0.50 | 0.70 | 1.00 |
| sealing characteristics | Good | Good | Good | Good | Good | Fair | Failed |
| Flange gall | Failed | Fair | Good | Good | Good | Good | Good |

This table 1 clearly shows that when the difference in the outer diameter is small, the seal characteristic is better, while the abutting pressure becomes higher, resulting in the flange galling. On the contrary, as the difference in the outer diameter increases, the abutting pressure on the flange is in a direction toward decrease, so the flange galling may be increasingly hindered, but the seal characteristic may get worse.

Then, it can been seen from this table 1 that the difference (D−d) between the outer diameter ϕD of the drum cylinder 111 and the outer diameter ϕd of the drum flange 112R is desirably in the range of 0.10 to 0.50 mm.

Further, in the case of such diameter difference, an average abutting pressure applied by the rear side seal 156R on the drum flange 112R is in the range of 0.01 to 0.02 MPa, and those conditions are such that may satisfy both the seal characteristic and wear resistance of the flange. Moreover, for measurement of the abutting pressure, Tactile Sensor (commodity description), I-SCAN (model number) available from NITTA CORPORATION was used as a measurement device for measuring a bearing pressure in sheet-like arrangement.

The abutting pressure on the flange portion 112 (the end portion) applied by the seal member is in the range of 0.01 to 0.02 MPa, and the abutting pressure on the cylinder portion 111 (the central portion) by the seal member is in the range of 0.015 to 0.05 MPa. Therefore, under conditions without giving out toner from the cylinder portion to the flange portion, the abutting pressure on the flange portion may be configured to be lower than that on the cylinder portion, so that it can be intended to satisfy both the toner leakage and flange galling.

Also, as shown in FIG. 5, the side seal 156R includes a root portion 156*b* made of elastic material and a brush 156*d* made of fluorine fabric disposed on the elementary portion 156*b*, which are adhered to a mounting surface by using double-faced adhesive tape 156*a*. Further, a layer 156*c* is a base material layer for the brush. Specifications applied to the brush, as an example, may be such that a gauge is of 0.5 to 3.0 tex, a density is of 1 to 100 KF/inch$^2$ and a length is of 1 to 3 mm, approximately.

Here, the elementary portion 156*b* is used for the rear side seal 156R to produce the abutting pressure due to elasticity thereof. Then, the elementary portion 156*b* may allow the abutting pressures between the rear side seal 156R, and the drum flange 112R and the drum cylinder 111 to be set to values of a contact pressure that may not degrade the seal characteristic and eliminate occurrence of the flange galling.

Also, the fluorine fabric at the surface of the brush 156*d* may allow slip on the drum flange 112R and the drum cylinder 111 and wear resistance to improve further. In addition, in this embodiment, hairs 156*e* of the brush 156*d* are arranged to lean toward the longitudinal central portion of the drum cylinder 111. Accordingly, this may allow the toner running transversely away on the nip portion of the fur brush and the cleaning blade to be easily blocked.

Consequently, the flange galling may be reduced without the seal characteristic degradation by configuring the drum flange 112 smaller in outer diameter than the drum cylinder 111 to reduce the abutting pressure on the drum flange 112 applied by the side seal 156. Also, in the case of the photosensitive drum 11 of the conventional length used, this configuration may allow for realization of an image formation apparatus corresponding to a wider image and performance improvement of an image formation apparatus without necessity for driving up the costs.

Although, the present invention has been described with respect to the side seal 156 of the photosensitive member cleaner portion 14 as an example, the present invention should not be limited to this and is applicable to any seal members abutting on the surface of a photosensitive drum of a developing device and the like.

In the present invention, resin substrate galling may be reduced without seal characteristic degradation by configuring a resin substrate smaller in outer diameter than a photosensitive portion to reduce a contact pressure on the resin substrate applied by a seal member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-266115, filed Sep. 13, 2005 which is hereby incorporated by reference herein in its entirety.

What is claimed is:

1. An image formation apparatus, comprising:

an image bearing member including a photosensitive portion on which a toner image is formed;

a resin flange that is provided at an end portion of said image bearing member and transmits a rotation force to said image bearing member, an outer diameter of the flange being smaller than an outer diameter of said image bearing member;

a cleaning unit for removing residual toner from the image bearing member; and a seal member, which prevents toner from leaking from an end of said cleaning unit, wherein said seal member is in contact with both of the end portion of said image bearing member and said flange, and wherein a contact pressure between said flange and said seal member is lower than a contact pressure between said photosensitive portion and said seal member.

2. An image formation apparatus according to claim 1, wherein a difference between an outer diameter of said image bearing member and an outer diameter of said flange is within a range of 0.10 to 0.50 mm.

3. An image formation apparatus according to claim 1, wherein said seal member comprises a root part made of elastic material and a brush layer, and wherein hairs of said brush layer lean toward a center portion of said image bearing member in a longitudinal direction of said image bearing member.

* * * * *